US006450270B1

(12) United States Patent
Saxton

(10) Patent No.: US 6,450,270 B1
(45) Date of Patent: Sep. 17, 2002

(54) ROTARY CONE BIT FOR CUTTING REMOVAL

(76) Inventor: Robert L. Saxton, 513 Egret La., Greenville, TX (US) 75402

( * ) Notice: Subject to any disclaimer, the term of this patent is extended or adjusted under 35 U.S.C. 154(b) by 0 days.

(21) Appl. No.: 09/669,998

(22) Filed: Sep. 25, 2000

(Under 37 CFR 1.47)

Related U.S. Application Data

(60) Provisional application No. 60/156,059, filed on Sep. 24, 1999.

(51) Int. Cl.[7] ..... E21B 10/08

(52) U.S. Cl. ..... 175/339; 175/372

(58) Field of Search ..... 175/372, 327, 175/371, 340, 339, 365, 350

(56) References Cited

U.S. PATENT DOCUMENTS

| | | | | |
|---|---|---|---|---|
| 4,802,539 A | * | 2/1989 | Hall et al. | 175/329 |
| 4,989,680 A | * | 2/1991 | Deane et al. | 175/340 |
| 5,010,789 A | | 4/1991 | Brett et al. | |
| 5,090,492 A | | 2/1992 | Keith | |
| 5,244,039 A | | 9/1993 | Newton, Jr. et al. | |
| 5,265,685 A | | 11/1993 | Keith et al. | |
| 5,415,243 A | * | 5/1995 | Lyon et al. | 175/331 |
| 5,524,510 A | * | 6/1996 | Davies et al. | 175/375 X |
| 5,551,522 A | | 9/1996 | Keith et al. | |
| 5,803,196 A | | 9/1998 | Fielder | |
| 5,967,246 A | | 10/1999 | Caraway et al. | |
| 5,967,247 A | | 10/1999 | Pessier | |
| 6,009,962 A | | 1/2000 | Beaton | |
| 6,089,336 A | | 7/2000 | Nexton et al. | |
| 6,116,357 A | * | 9/2000 | Wagoner et al. | 175/228 |
| 6,129,161 A | | 10/2000 | Roberts et al. | |
| 6,142,248 A | * | 11/2000 | Thigpen et al. | 175/340 |

FOREIGN PATENT DOCUMENTS

GB 2 326 659 A 12/1998

* cited by examiner

*Primary Examiner*—Frank S. Tsay
(74) *Attorney, Agent, or Firm*—Baker Botts L.L.P.

(57) ABSTRACT

An improved rotary cone bit includes a threaded end on a bit body for coupling to a drill string. The drill bit body includes two or more leg portions extending from one end thereof. From interval at each of the leg portions is a bearing pin that extends inwardly toward the longitudinal axis of the drill bit body. On each of the bearing pins, there is rotatably mounted a cutter cone having rows of cutting teeth as a part hereof. The bit shirttail comprises a plateau extending along the longitudinal axis of the bit body in substantially the same plane as the bearing pin surface area of the shirttail.

12 Claims, 2 Drawing Sheets

ROTARY CONE BIT FOR CUTTING REMOVAL

RELATED APPLICATION

This application claims the benefit of U.S. provisional application Serial No. 60/156,059, filed Sep. 24, 1999, entitled Rotary Cone Bit for Cutting Removal.

Inventor: Robert L. Saxton.

TECHNICAL FIELD OF THE INVENTION

The present invention relates to rotary cone bits, and in particular to a rotary cone bit having a bit body for enhanced cutting removal.

BACKGROUND OF THE INVENTION

Rotary cone bits are well known in the art of drilling. The most common design of a rolling cone bit consists of three generally conical shaped cutters, each rotatably mounted on a downwardly extending bearing pin. Each of the bearing pins is spaced approximately 120° apart with the three pins formed as a part of a bit body. The entire structure is rotated at the end of a drill string. Boring is accomplished by applying weight to the drill bit and rotating the drill string, thereby causing the cutters to roll and crush the rock formation beneath the bit. As the bit is rotated and moves through a formation, the cutter elements contact and disintegrate portions of the formation in order to form the desired bore hole. A large portion of the cuttings produced by the drilling operation are in the form of finely divided particles which create a highly abrasive environment. These cuttings from the bottom and sides of the bore hole are washed away by a drilling fluid, such as air or drill mud, that is supplied to the drill bit from the surface through the hollow rotating drill string. The cuttings are carried to the surface suspended in the drilling fluid.

The grinding and re-grinding of the cuttings produced by the drilling operation slows the formation penetration rate of the bit and shortens the life of the bit. The re-ground cuttings tend to dull the cutters and the finely ground particles are forced into the bearing surfaces formed between the roller cones and the journals supported by the bit, further limiting bit life.

In conventional drill bit construction, the drilling fluid, either drilling mud or air, is directed by nozzles against the cutter cones to wash the cuttings from the cutter cone and the bore hole. Often, the direction of the drilling fluid against the cutter cone results in trapping some of the cuttings along the bottom of the hole with the result that the cuttings are re-ground to an abrasive powder before removal.

Thus, there is a need for an improved rotary cone bit having leg portions configured to enhance chip removal from the bore hole bottom. In addition, there is a need for an improved rotary cone bit having nozzle location and configuration to enhance chip removal from the cutter cones and the bore hole bottom.

SUMMARY OF THE INVENTION

In accordance with the present invention, there is provided an improved rotary cone bit having a threaded end for coupling to a drill string and including a drill bit body having two or more leg portions extending from one end of the body. Formed integral with each of the leg portions is a bearing pin that extends inwardly toward the longitudinal axis of the drill bit body. On each of the bearing pins, there is rotatably mounted a cutter cone having rows of cutting teeth as a part thereof. The bit shirttail comprises a plateau extending along the longitudinal axis in substantially the same plane as the bearing pin surface area of the shirttail.

Further, the improved rotary cone bit of the present invention comprises a plateau on each of the leg portions of the bit body. The plateau is part of the shirttail of the leg portion and extends along the longitudinal axis of the bit from the bearing pin surface area to the threaded end. The surface of the plateau extends in substantially the same plane as the bearing pin surface area until a break point at which the plateau tapers to the threaded end. The break point is about between one-third to two-thirds of the length of the plateau from the bearing pin surface area to the threaded end. Further, the improved rotary cone bit of the present invention includes a first contoured surface on the leg portion wherein the first contoured surface is contiguous to the plateau and has a longitudinal axis substantially parallel to the longitudinal axis of the bit body. The first contoured surface is angled down and away from the plateau and extends from the bearing pin surface area to the threaded end. A second contoured surface also formed on the shirttail of the leg portion is contiguous to the plateau and has a longitudinal axis substantially parallel to the longitudinal axis of the bit body. This second contoured surface is angled down and away from the plateau and extends from the bearing pin surface area to the threaded end.

BRIEF DESCRIPTION OF THE DRAWINGS

A more complete understanding of the rotary cone bit of the present invention may be had with reference to the following detailed description taken in conjunction with the accompanying drawings, wherein.

DETAILED DESCRIPTION OF THE DRAWINGS

Figure 1:
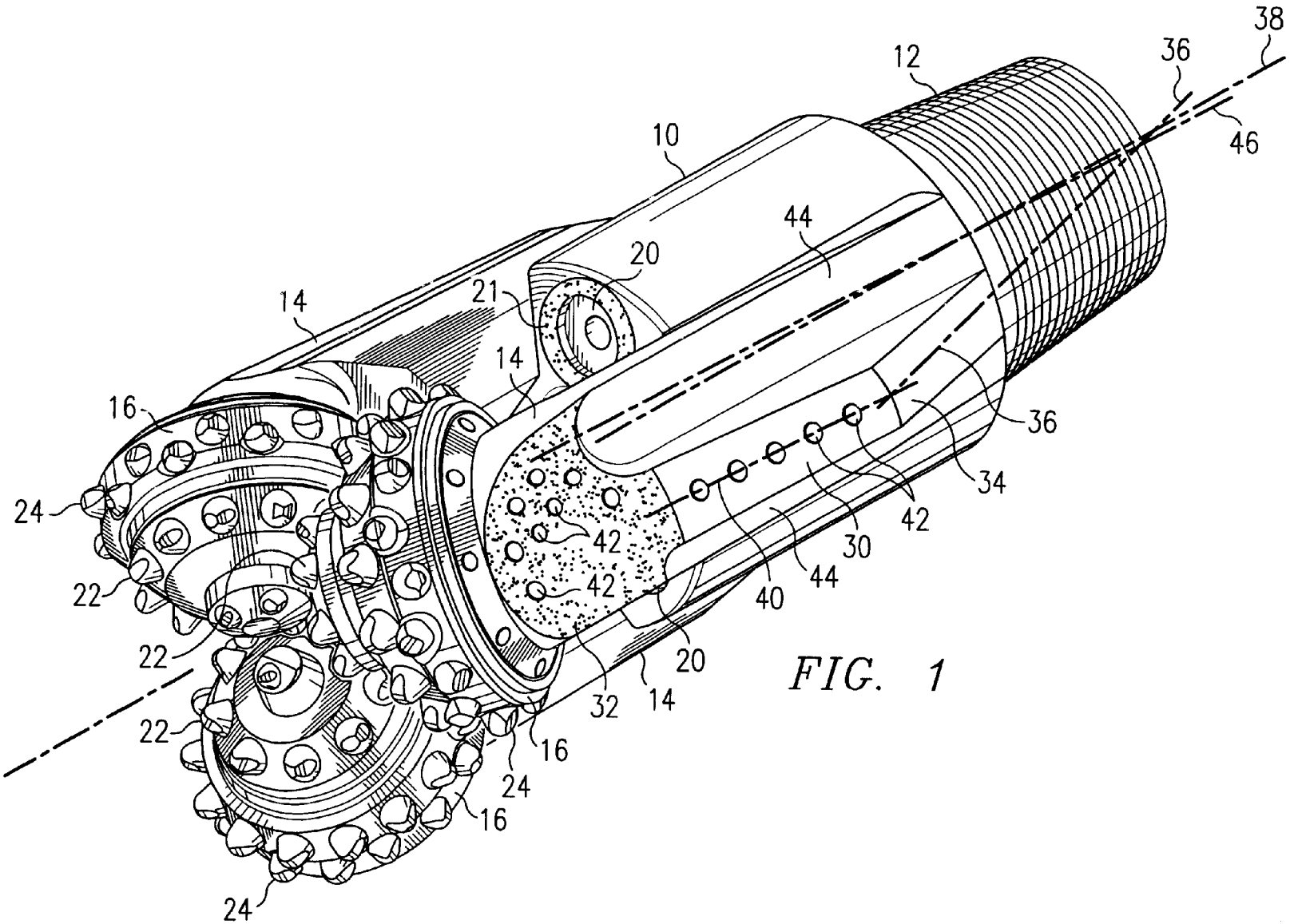
FIG. 1 is a perspective view of a rotary cone bit with improved chip removal enhancements.

In accordance with the present invention, there is provided a rotary cone bit having a contoured shirttail for enhanced cutting removal from a bore hole. The rotary cone bit of the present invention includes a bit body having a central vertical axis and a threaded shank for connection to a drill string. The shank is formed on one end of the bit body and includes a central vertical axis coaxial with the central vertical axis of the bit body.

Three legs extend from a second end of the bit body. A bearing pin is formed integral to each of the three respective leg portions and extends inwardly and downwardly approximately toward the central vertical axis of the bit body. Each bearing pin terminates in a bearing pin surface area as a part of the shirttail.

A rolling cutter is rotatably mounted on each respective bearing pin in accordance with conventional sealing and cutter retaining techniques.

In accordance with the present invention, the shirttail of each leg portion includes a longitudinal axis approximately intersecting the vertical axis of the bit body. Extending along this longitudinal axis for each of the bearing pins is a ridge surface or plateau from the bearing pin surface area to the threaded shank. This ridge surface or plateau extends in substantially the same plane as the bearing pin surface area from about one-third to two-thirds of the distance between the bearing pin surface area and the threaded shank. The ridge surface or plateau then tapers to the threaded shank. On either side of the ridge surface or plateau there is integrally formed therewith a contoured surface having a longitudinal axis substantially parallel to the longitudinal axis of the plateau.

Reference is now made to the drawings wherein like reference characters denote like or similar parts throughout the three figures.

Refer now to FIG. 1, there is shown a rotary cone bit including a bit body 10 having at one end a threaded shank 12 for attachment to a drill string member (not shown). The threaded shank 12 is adapted to be threadably engaged with a drill string in accordance with conventional drill bit construction. Extending from the bit body 10 are three leg portions 14 providing support for a rotatable roller cutter cone 16. Both the bit body 10 and the shank 12 have an axially extending hollow passage terminating in nozzles 20 (only one shown) for directing drilling fluid, such as drilling mud or air, to flush the bore hole of debris during the drilling operation. The passage terminates in nozzles 20 positioned between each of the three cones. Each of the nozzles is surrounded by a hard facing ring 21 for improved wear resistance against debris circulating around the drill bit during a drilling operation in a bore hole.

As illustrated in FIG. 1, the roller cutter cones 16 have substantially the same base diameter to permit the cutting teeth on each cone to project between the cutting teeth of the other cutter cones. The cutting teeth 22 on each of the cutter cones 16 are arranged in rows and in the embodiment shown comprise tungsten carbide inserts press fit into the cone surface and projecting therefrom. Each of the cutter cones 16 is also provided with gage row teeth 24 such as carbine insert press fit into the cone surface and projecting therefrom.

The cutter cones 16 are journaled on respective leg portions 14 for rotation about a rotational axis of a bearing pin. This axis of rotation is inclined with respect to the vertical axis of the bit in accordance with conventional roller cone cutter techniques. The bearing structure and seal assembly for each of the cutter cones 16 is of a conventional design.

Figure 2:
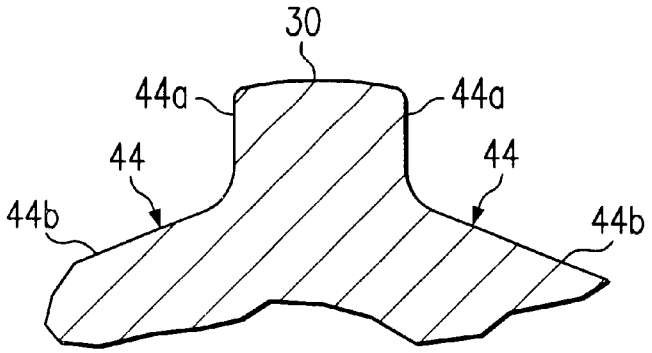
FIG. 2 is a partial cross-section through the shirttail of a leg portion of the rotary cone bit of FIG. 1 illustrating the shirttail plateau and contiguous contoured surfaces.
Figure 3:
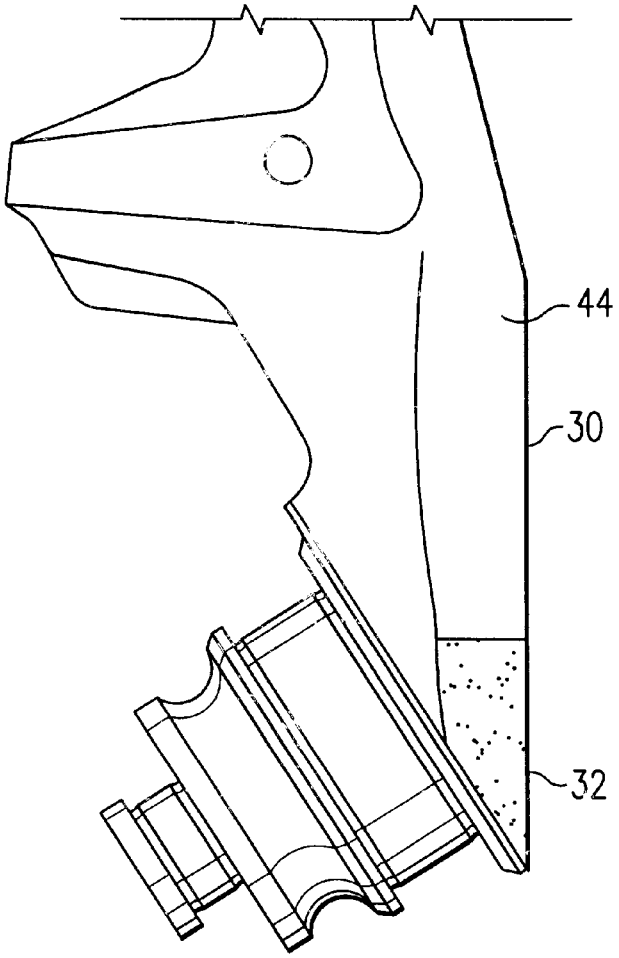
FIG. 3 is a partial side view of a leg portion of the rotary cone bit of FIG. 1 further showing the plateau and contiguous contoured surfaces.

Referring now to FIGS. 1, 2, and 3, each leg portion 14 includes a ridge surface or plateau 30 having a surface in substantially the same plane as a bearing pin surface area 32 and extending from the bearing pin surface area to a tapered surface 34 terminating at the threaded shank 12 at substantially the same dimension thereof. A longitudinal axis 36 of the tapered surface 34 intersects the longitudinal axis 38 of the threaded shank 12 and the bit body 10. The longitudinal axis 36 is an extension of a longitudinal axis 40 of the ridge surface or plateau 30. Each of the bearing pins is similarly configured to include the plateau 30 and the tapered surface 36. The ridge surface or plateau 30 and the bearing pin surface area 32 have a pattern of wear inserts 42 press fit into the surface of the ridge and the surface area. These wear inserts 42 provide additional wear resistance to the leg portion 14 as the drill bit rotates in a bore hole.

Contiguous with the ridge surface or plateau 30 on either side thereof is a contoured surface 44 having a first subsurface 44*a* at substantially right angles to the plateau 30 and a second subsurface 44*b* angled down and away from the plateau 30. As best illustrated in FIG. 1, the longitudinal axis 46 of the contoured surface 44 intersects the longitudinal axis 38 of the threaded shank 12 and the bit body 10. The contour surface 44 on each side of the plateau 30 is also angled down and away from the bearing pin surface area 32 to the diameter of the threaded shank 12.

As the roller cones 16 rotate in the bore hole bottom, the cutting teeth 22 scrape, gouge and crush the formation, thus creating rock chips which must be removed from the bore hole bottom.

In mining bits, air is used to remove these rock chips from the bore hole bottom and is directed through the nozzles 20 toward the bore hole bottom and the rock chips are blown out of the bore hole past the bit body primarily by means of the contoured surfaces 44. At the same time, the ridge surface or plateau 30 provides bit stabilization thereby enhancing drilling in a desired direction. The hard facing on the bearing pin surface area along with wear inserts 42 protect these surfaces from excessive wear during bore hole operation.

To further enhance rock chip removal from the bore hole, the nozzles 20 each have a discharge end positioned between adjacent leg portions to direct drilling fluid between the cutter cones for rock chip removal. Each of the nozzles 20 terminates at the dome of the drill bit as formed by the assembly of the three leg portions. By locating the exit of each of the nozzles 20 in this dome area, there results an enhancement of rock chip removal from the bore hole.

Although only one embodiment of the invention has been illustrated in the accompanied drawings and described in the foregoing detailed description, it will be understood that the invention is not limited to the disclosed embodiment but is capable of numerous modifications without departing from the scope of the invention as claimed.

What is claimed is:

1. An improved rotary cone bit, comprising:

a drill bit body having a threaded end and two or more leg portions extending from an end of the bit body, and a plurality of bearing pins, one each forming a part of a respective leg portion of the bit body, each bearing pin extending inwardly;

a plurality of cutter cones, one each of said cones journaled to rotate on the respective bearing pin;

at least one nozzle in the bit body for directing a drilling fluid between and around the cutter cones;

wherein each of the leg portions of the bit body has a longitudinal axis and a bearing pin surface area, each of the leg portions of the bit body comprising:

a plateau extending along the longitudinal axis from the bearing pin surface area toward the threaded end, the surface of the plateau extending in substantially the same plane and having substantially the same surface configuration as the bearing pin surface area, and the surface of the plateau tapering to the threaded end, the surface of the plateau extends in the same plane as the plane of the bearing pin surface area from the bearing pin surface area about one-third to two-thirds of the distance between the bearing pin surface area to the threaded end;

a first contoured surface contiguous to a first side of the plateau and having a longitudinal axis substantially parallel to the longitudinal axis of the plateau, said first contoured surface angled down and away from the plateau and extending from the bearing pin surface area to the threaded end; and a second contoured surface contiguous to a second side of the plateau opposite from the first side and having a longitudinal axis substantially parallel to the longitudinal axis of the plateau, said second contoured surface angled down and away from the plateau and extending from the bearing pin surface area to the threaded end.

2. The improved rotary cone bit as set forth in claim 1 wherein the first contoured surface and the second contoured surface slant down and away from the bearing pin surface area to the threaded end.

3. The improved rotary cone bit as set forth in claim 1 further comprising a hard facing on the bearing pin surface area.

4. The improved rotary cone bit as set forth in claim 1 wherein the at least one nozzle comprises a nozzle having a discharge end positioned between adjacent leg portions for directing the drilling fluid between the cutter cones.

5. The improved rotary cone bit as set forth in claim 4 further comprising a hard facing around the discharge end of each of the at least one nozzles.

6. The improved rotary cone bit as set forth in claim 1 including a plurality of gage inserts mounted in the bearing pin surface area.

7. The improved rotary cone bit as set forth in claim 6 further comprising a plurality of gage inserts mounted in the surface of the plateau.

8. An improved rotary cone bit, comprising:

a drill bit body having a threaded end; and two or more leg portions extending from an end of the bit body, at least one nozzle in the bit body for directing a drilling fluid between adjacent leg portions;

wherein each of the leg portions has a longitudinal axis, each of the leg portions comprising:

a plateau extending along the longitudinal axis toward the threaded end, the surface of the plateau tapering to the threaded end;

a first contoured surface contiguous to a first side of the plateau and having a longitudinal axis substantially parallel to the longitudinal axis of the plateau, said first contoured surface angled down and away from the plateau and extending to the threaded end; and a second contoured surface contiguous to a second side of the plateau opposite from the first side and having a longitudinal axis substantially parallel to the longitudinal axis of the plateau, said second contoured surface angled down and away from the plateau and extending to the threaded end.

9. The improved rotary cone bit as set forth in claim 8, wherein the first contoured surface and the second contoured surface slant down and away to the threaded end.

10. The improved rotary cone bit as set forth in claim 8, wherein the at least one nozzle comprises a nozzle having a discharge end positioned between adjacent leg portions for directing the drilling fluid between the leg portions.

11. The improved rotary cone bit as set forth in claim 10 further comprising a hard facing around the discharge end of the at least one nozzle.

12. The improved rotary cone bit as set forth in claim 8 further comprising a plurality of inserts mounted in the surface of the plateau.

* * * * *